US007503317B2

(12) United States Patent
Nelson et al.

(10) Patent No.: US 7,503,317 B2
(45) Date of Patent: Mar. 17, 2009

(54) INTERNAL BREATHER FOR AN INTERNAL COMBUSTION ENGINE

(75) Inventors: Dean M. Nelson, Waldo, WI (US); Jonathan R. Chittenden, Edwards, IL (US); Daniel F. Krueger, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 78 days.

(21) Appl. No.: 11/530,303

(22) Filed: Sep. 8, 2006

(65) Prior Publication Data

US 2007/0056571 A1 Mar. 15, 2007

Related U.S. Application Data

(60) Provisional application No. 60/717,176, filed on Sep. 15, 2005.

(51) Int. Cl.
*F02M 25/06* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 2,055,308 A * 9/1936 Puff ..... 123/41.86
4,881,510 A 11/1989 Etoh et al.
5,123,385 A 6/1992 Sado et al.
5,542,402 A * 8/1996 Lee et al. ..... 123/573
6,065,457 A 5/2000 Hoffmann et al.
6,213,107 B1 4/2001 Gyllenstedt
6,263,847 B1 7/2001 Hoffmann et al.
6,345,613 B1 2/2002 Hoffmann et al.
6,431,157 B1 * 8/2002 Marcil ..... 123/568.11
6,758,197 B2 7/2004 Korenjak et al.

(Continued)

FOREIGN PATENT DOCUMENTS

DE 10257012 A1 6/2004

(Continued)

OTHER PUBLICATIONS

Kohler Engines, Command 18-25 HP Parts Manual, issued Aug. 1995.

*Primary Examiner*—M. McMahon
(74) *Attorney, Agent, or Firm*—Whyte Hirschboeck Dudek SC

(57) ABSTRACT

An internal breather for removing oil from blow-by in an internal combustion engine is disclosed. The breather includes a breather cover having a breather cover drainback hole. The breather further includes a breather cover seal in sealed engagement with the breather cover, and the breather cover seal includes a breather cover seal drainback hole that is aligned with the breather cover drainback hole to create a drainback passage. A breather chamber is bounded on at least one end by the breather cover and the breather seal. A breather media is positioned within the breather chamber, the breather media for removing an amount of oil from the blow-by. The amount of oil removed from the blow-by can, during operation of the engine, be drawn through the drainback passage so as to exit the breather chamber, at least partially due to gravity, and at least partially using a gearing mechanism that is in operative association with a camshaft of the engine. Advantageously, the gearing mechanism, for example a helical gear, can be strategically positioned in-line with the drainback passage.

20 Claims, 4 Drawing Sheets

U.S. PATENT DOCUMENTS

| | | | | |
|---|---|---|---|---|
| 6,907,869 | B2 | 6/2005 | Burgess et al. | |
| 2004/0244785 | A1 * | 12/2004 | Nishikawa et al. | 123/574 |
| 2005/0205072 | A1 * | 9/2005 | Sharman | 123/573 |

FOREIGN PATENT DOCUMENTS

| | | |
|---|---|---|
| JP | 59-70825 | 4/1984 |
| JP | 4-159410 | 6/1992 |

* cited by examiner

INTERNAL BREATHER FOR AN INTERNAL COMBUSTION ENGINE

CROSS REFERENCE TO RELATED APPLICATION

This application is claims the benefit under 35 USC §119 (e) of U.S. Provisional Application No. 60/717,176, filed Sep. 15, 2005, the teachings and disclosures of which are incorporated herein by reference.

FIELD OF THE INVENTION

The invention relates generally to breathers for use with internal combustion engines, and more particularly, to internal breathers.

BACKGROUND OF THE INVENTION

In internal combustion engines, pistons are housed within corresponding cylinders for reciprocating movement therein. Fuel and air enter a combustion chamber in a cylinder on a first side of a piston. The fuel in the combustion chamber is ignited to cause linear motion of the piston inside the respective cylinder. The linear motion of the piston is then converted to rotary motion by the crankshaft.

Ideally, all of the gases in the combustion chamber(s) after ignition of the fuel would be exhausted via an engine exhaust pipe. However, a portion of the combustion gases typically passes between the piston rings and the cylinder walls of the cylinders housing the pistons. The combustion gases typically are routed through the crankcase and into the air intake system of the engine so as to prevent pressurizing the crankcase. During such routing of the combustion gases, the gases often become contaminated with oil mist as the high pressure gases are blown past the piston rings into the crankcase. The mixture of combustion gases and oil mist is known as crankcase blow-by, or simply blow-by.

A breather apparatus can be attached to, or incorporated into, an internal combustion engine so that the oil content in the blow-by gas is separated out. The oil can then be returned to inner components of the engine, such as an oil pan. Breathers typically fall into two classifications: external canister-type breathers that can be attached to the engine, and internal-type breathers that are integral to (or otherwise formed as part of) the engine crankcase. An external canister-type breather is typically attached to the crankcase and induction system via hoses. This utilizes multiple assembly joints that require assembly time and create a potential for oil leakage. Additionally, the canister is placed on the outside of the engine and takes up much desired space. Further, the path from the crankcase through the canister is not readily accessible.

In contrast, an internal breather is typically formed into the crankcase. While not requiring numerous hoses, or occupying large amounts of space outside the engine, an internal breather typically adds cost to both the casting tool and the casting piece price, as the casting is more complex. Moreover, there are additional costs to machine the casting itself.

For at least these reasons, therefore, an improved internal breather device for separating oil from blow-by in an internal combustion engine is desired.

BRIEF SUMMARY OF THE INVENTION

In one embodiment, an internal breather for removing oil from blow-by in an internal combustion engine is disclosed. The breather includes a breather cover having a breather cover drainback hole, The breather further includes a breather cover seal in sealed engagement with the breather cover, and the breather cover seal includes a breather cover seal drainback hole that is aligned with the breather cover drainback hole to create a drainback passage. A breather chamber is bounded on at least one end by the breather cover and the breather seal. A breather media is positioned within the breather chamber, the breather media for removing an amount of oil from the blow-by. The amount of oil removed from the blow-by can, during operation of the engine, be drawn through the drainback passage so as to exit the breather chamber, at least partially due to gravity, and at least partially using a gearing mechanism that is in operative association with a camshaft of the engine.

Advantageously, in one embodiment, the internal breather gearing mechanism, for example a helical gear, is strategically positioned in-line with the drainback passage.

BRIEF DESCRIPTION OF THE DRAWINGS

Embodiments of the invention are disclosed with reference to the accompanying drawings and are for illustrative purposes only. The invention is not limited in its application to the details of construction or the arrangement of the components illustrated in the drawings, The invention is capable of other embodiments or of being practiced or carried out in other various ways. Like reference numerals are used to indicate like components. In the drawings.

DETAILED DESCRIPTION OF THE PREFERRED EMBODIMENT(S)

Figure 1:
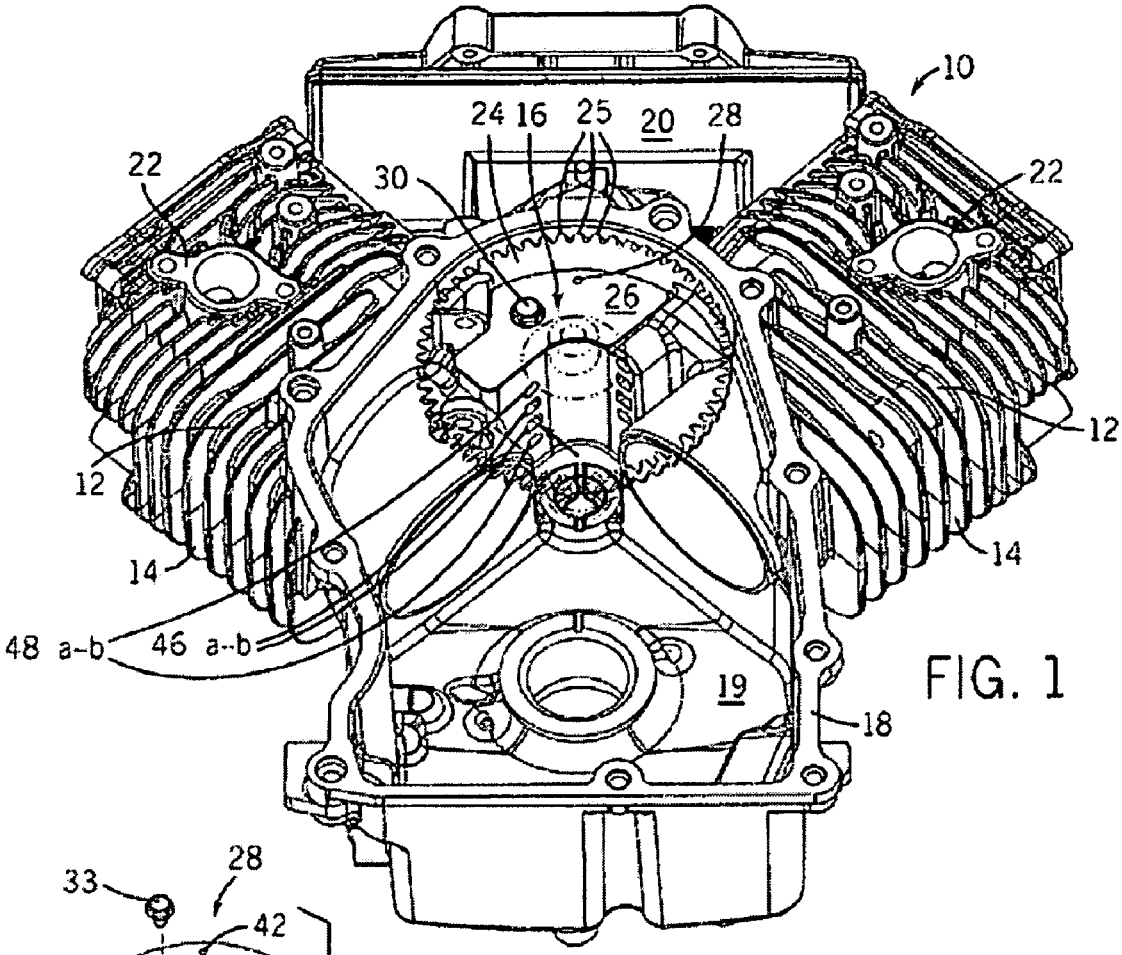
FIG. 1 is a partial bottom interior perspective view of a V-twin internal combustion engine having an internal breather, according to one aspect of the present invention.

FIG. 1 is a partial bottom interior perspective view of an internal combustion engine, and more specifically, a V-twin engine 10 having two cylinders 12 and cooling fins 14, and including a breather, indicated generally by numeral 16, according to one embodiment of the present invention. Engine 10 further includes a crankcase 18 defining a crankcase compartment 19, and a carburetor (hidden from view). An air intake manifold 20 is also shown to be positioned between the two cylinders 12. The breather 16 is an internal-type breather in that it is internal to the engine 10, and more specifically, internal to the crankcase 18. The breather 16 can be one or both of cast into the crankcase and machined into the casting. As shown, the breather 16 includes a breather cover 26 that is secured in place via a screw 33. Also, a helical gear 24 (shown in phantom) having gear teeth, designated by numeral 25, of a predetermined helix angle is connected to a camshaft (not numbered, but also shown in phantom). Helical gear 24 is positioned over breather 16. Further shown in FIG. 1 are exhaust ports 22 along top sides of the cylinder heads.

Figure 2:
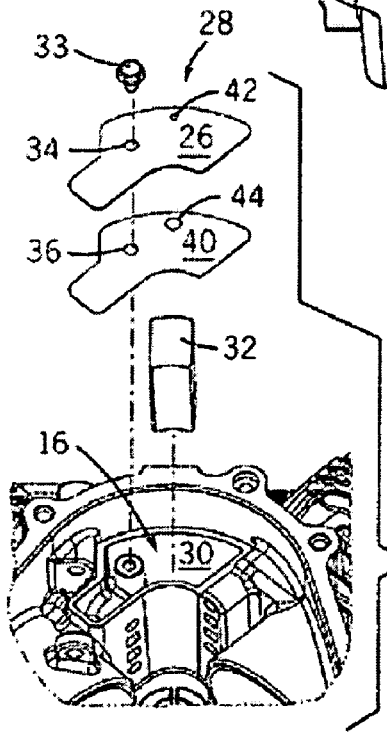
FIG. 2 is an exploded view of the breather 16 of FIG. 1 illustrating a breather chamber, breather cover, screw and breather cover sealing gasket.

FIG. 2 is an exploded view of the breather 16 of FIG. 1. As illustrated, breather 16 includes a breather chamber 30 and a breather media or filter 32. The breather media 32 is used for capturing or accumulating an amount of oil from blow-by as it flows within the breather 16 due to the coalescing of the liquids onto the surface of the breather media fibers. The screw 33 passes through breather cover screw hole 34 and breather cover seal screw hole 36 formed in a breather cover 26 and a breather cover seal 40 (e.g., a sealing gasket), respectively. Screw 33 serves as a fastening means to secure the gasket and cover, so as to bound and enclose, the breather chamber 30 in sealed fashion. Stated another way, the breather chamber 30 is bounded on at least one end by the breather cover 26 and the breather cover seal 40. A drainback passage 28 is formed via alignment of breather cover drainback hole 42 and breather cover seal drainback hole 44 in breather cover 26 and the breather cover seal 40, respectively.

Figure 3:
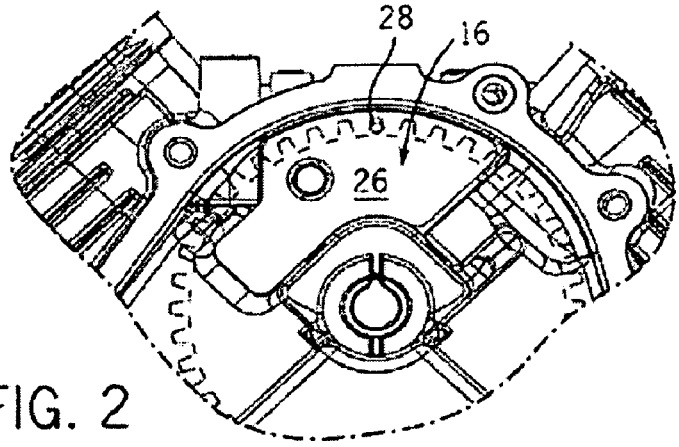
FIG. 3 is a top view of the breather shown in FIG. 1, showing "in-line" positioning of a camshaft helical gear with respect to a drainback passage of the breather.

FIG. 3 is a top view of the breather 16 shown in FIG. 1 with the breather cover 26 shown in place. Significantly, the helical gear (again shown in phantom), and more specifically the teeth of the helical gear, are shown to be positioned "in-line" with respect to the breather drainback passage 28. As will be described in detail again below with respect to the figures illustrating the functionality of the breather 16, positioning the helical gear "in-line" with the drainback passage advantageously draws oil (collected from blow-by) out of the breather.

Figure 4:
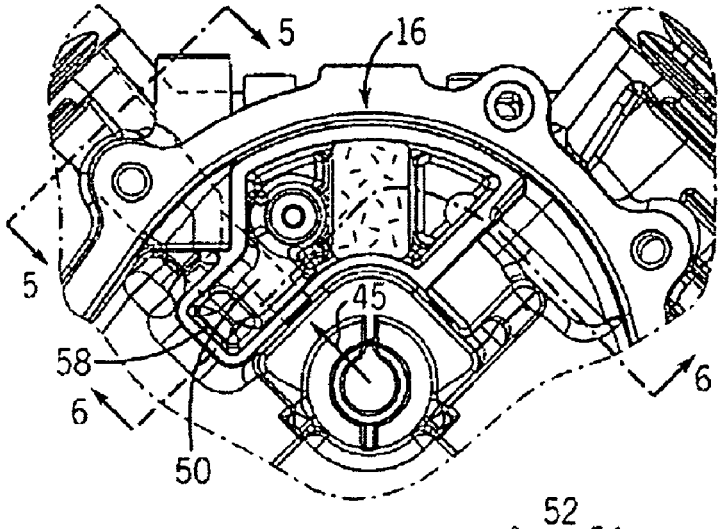
FIG. 4 is a bottom view of the breather illustrated in FIG. 2 with the breather cover, screw and sealing gasket removed.
Figure 4A:
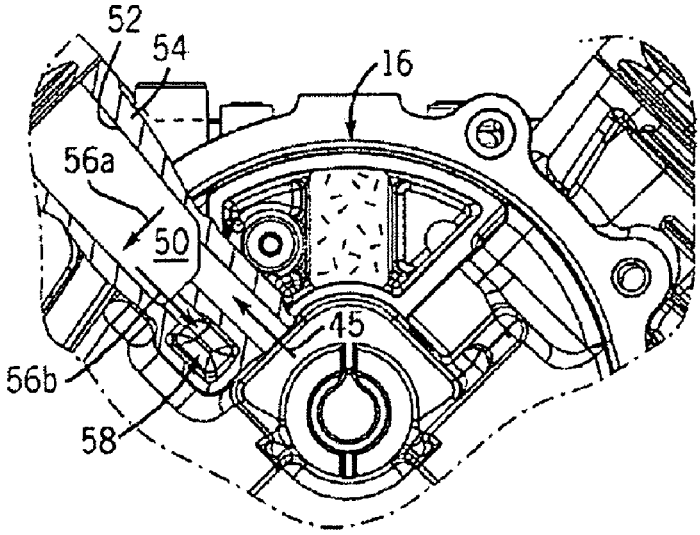
FIG. 4A is a partial breakaway view of FIG. 4 showing blow-by passing through a cylinder head blow-by passageway to the breather.

FIG. 4 is a bottom view of the breather 16 illustrated in FIG. 2 with the breather cover, screw and sealing gasket removed so as to expose the breather interior. The view illustrates the breather and a portion of the engine looking down towards the bottom of the engine, which is in a position upside down relative to normal operation of the engine. FIG. 4A is a partial breakaway view of FIG. 4. Referring to FIGS. 1, 4 and 4A, blow-by within the crankcase 18 (which is collected within and fills the crankcase during combustion) flows, as indicated by arrows 45, due to pressure differential via the plurality of passages 46*a-b* into a crankcase passageway, and more specifically as shown, a cylinder head blow-by passageway 50. Also shown (FIG. 1) are bores 48*a-b* within which engine lifters move. The cylinder head blow-by passageway 50 is defined by a cylinder head wall 52 of a cylinder head 54. The crankcase passageway (again, in this case, a cylinder head blow-by passageway) 50 is located within the crankcase. The crankcase passageway extends to, and is in fluid communication with, the breather 16. This permits blow-by to flow from the crankcase passageway 50 into the breather 16.

Advantageously, the plurality of passages 46*a-b*, which permit passage of engine blow-by, are engine drainback passages. Thus, these passages are already-formed (or stated another way, already-existing) passages typically found in internal combustion engines of the kind illustrated. As such, the plurality of passages 46*a-b* can be termed "dual purpose" passages in that these passages are formed to both permit drainback and to permit passage or flow of engine blow-by. The cylinder head blow-by passageway 50 extends within the crankcase 18 to the breather 16. Arrows 56*a-b* indicate blow-by flowing through the cylinder head blow-by passageway 50 to the breather 16, with blow-by entering the breather via a cored hole 58 (also termed herein as a "breather chamber inlet port"). As shown, the hole 58 is oblong-shaped.

Figure 5:
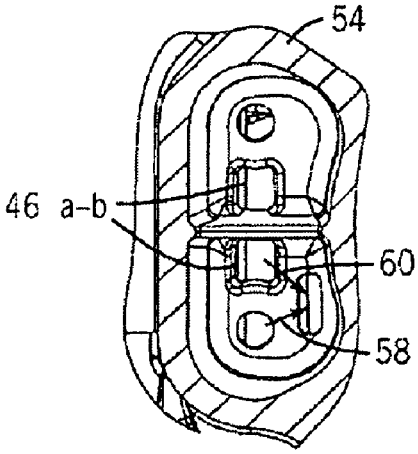
FIG. 5 is cross-sectional view taken along line 5-5 of FIG. 4 showing blow-by entering the breather.

FIG. 5 is a cross-sectional view taken along line 5-5 of FIG. 4. More specifically, blow-by is shown flowing, as indicated by arrows 60, from the cylinder head blowby passageway 50 of cylinder head 54 into the breather 16 via the cored hole 58. Again, the blow-by is shown entering the cylinder head blowby passageway 50 via the plurality of passages 46*a-b*, (which are shown from a reverse perspective).

Figure 6:
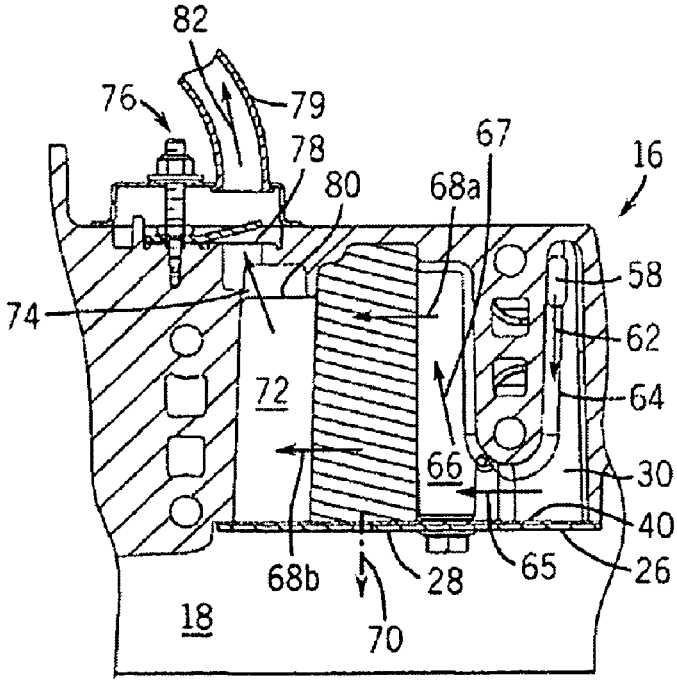
FIG. 6 is a cross-sectional view taken along line 6-6 of FIG. 4, with the image rotated 180 degrees to show blow-by flowing into, through and out of the breather during engine operation.

FIG. 6 is a cross-sectional view taken along line 6-6 of FIG. 4, with the image rotated 180 degrees to so show blow-by flowing into, through and out of the breather chamber 30 of breather 16 during engine operation, More specifically, blow-by enters the breather chamber 30 via the breather chamber inlet port (or cored hole) 58. Once inside the breather chamber 30 of the breather 16, chamber geometry and pressure differential cause blow-by to immediately turn (as shown blow-by turns 90 degrees), and flow, as indicated by arrow 62, through a first, more narrow, breather chamber portion 64 and towards the breather cover and seal 26 and 40, respectively. Upon reaching the breather cover 26 and seal 40 within the breather chamber 30, blow-by turns (again as shown blow-by turns 90 degrees) and flows, as indicated by arrow 65, turning again into a second breather chamber portion 66. The second breather chamber portion 66 has a larger cross-sectional area and volume than the first breather chamber portion 64, and as such, the velocity of the blow-by is substantially reduced as the blow-by enters the second breather chamber portion. The reduction in blow-by velocity (due to increased chamber volume) is indicated by arrow 67. Stated another way, the second breather chamber portion 66 has a larger cross-sectional area than the first breather chamber portion 64, and thus, there is a reduction in velocity of the blow-by passing from the first breather chamber portion to the second breather chamber portion prior to the blow-by passing into a breather media 32.

Blow-by within the second breather chamber portion 66 (now flowing more slowly) is drawn, indicated by arrows 68*a-b*, to the breather media or filter element 32 that, in a preferred embodiment, comprises a coated fabric material. Advantageously, blow-by follows a tortuous path with the engine and within the breather. This path involves a number of directional changes, or turns, and when blow-by takes these turns, some liquid will contact and adhere to the walls of the chamber and drain back into the crankcase.

As the blow-by passes through the breather media 32, oil coalesces on the media, and falls due to gravity, which is indicated by dashed arrow 70, and flows through the drainback passage 28, thereby draining oil from the breather 30. Again, as noted previously, drainback passage 28 is positioned strategically in-line with the gearing mechanism employed (see FIGS. 1 and 3 at numeral 24, referencing the helical gear). The helix angle of the gearing mechanism can be selected to assist in the draining of oil from the breather chamber by acting as a fan and drawing the oil through the drainback passage 28 back into the crankcase 18. In one embodiment, a 25.4 degree helix angle gear is used. However, in other embodiments, other gearing mechanisms (e.g., helical gears, worm gears, bevel gears, etc.) may be desired and selected, and such selection is contemplated and considered within the scope of the invention. Thus, the amount of oil removed from the blow-by can, during operation of the engine, be drawn through the drainback passage so as to exit the breather chamber 30 at least partially due to gravity, and at least partially using the gearing mechanism (e.g., a helical gear) connected to a camshaft of the engine. It is contemplated that removal of oil from the breather may be facilitated due to a pressure differential between the breather chamber portions.

Figure 10:
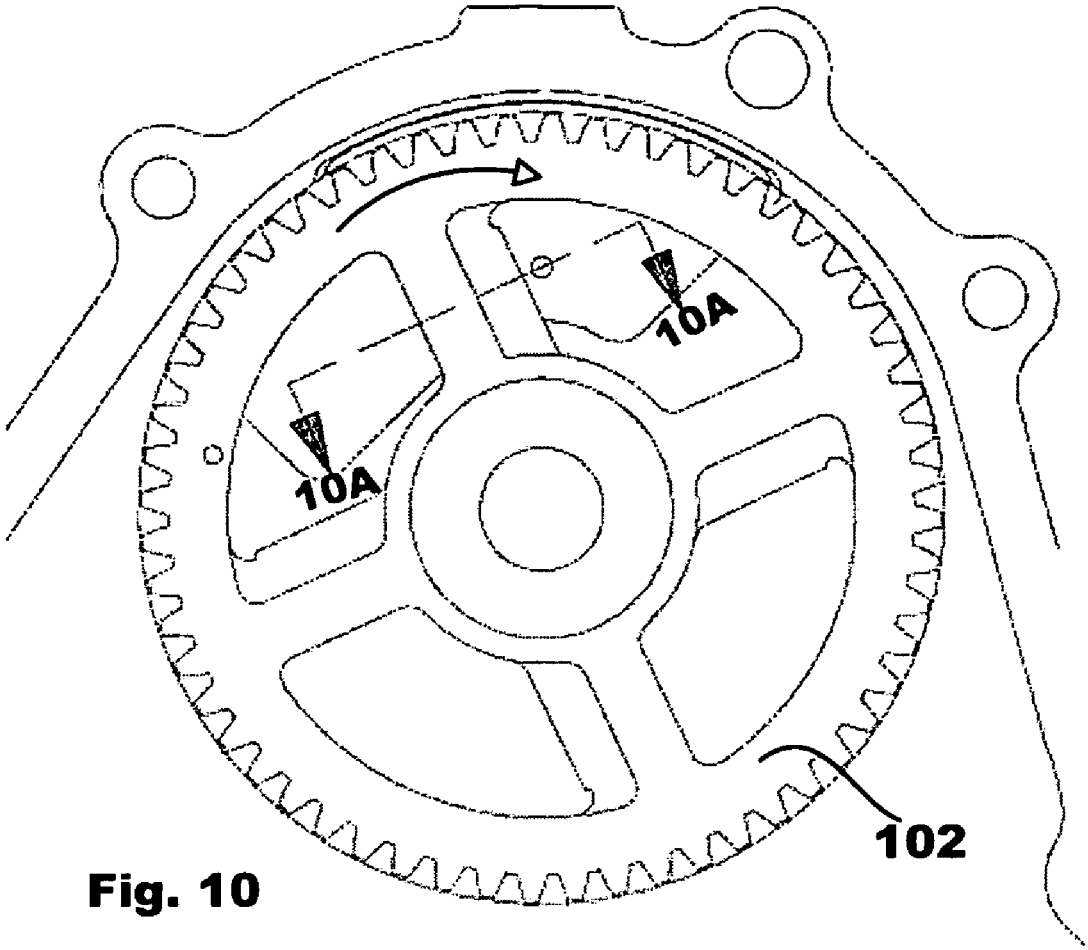
FIGS. 10 and 10*a* are top and cross-sectional views, respectively, of the internal breather of FIG. 1 positioned in relation to a camshaft having one or more blade mechanisms, with the cross-sectional view being taken along lines 10A-10A of FIG. 10, in accordance with at least some embodiments of the present invention.
Figure 10A:
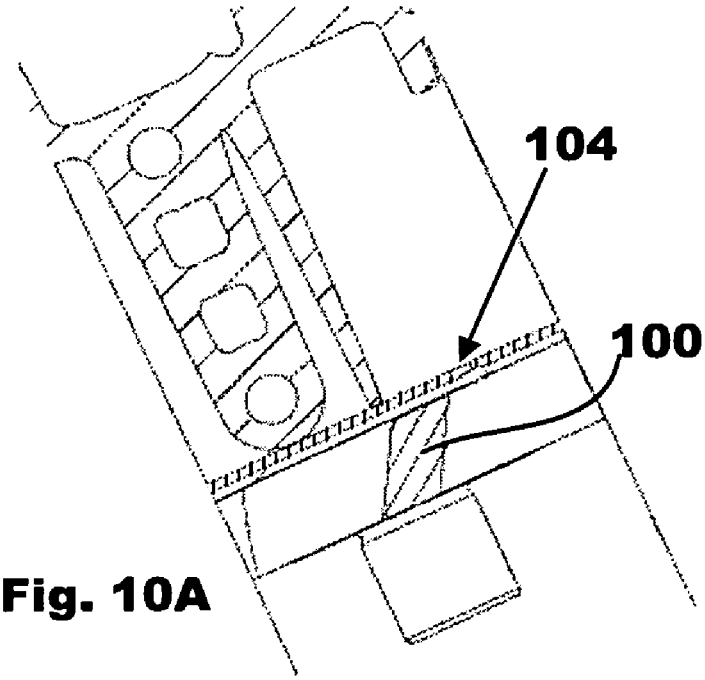

In other embodiments, it is further contemplated that other mechanisms and/or components could be used in conjunction with, or without, the aforementioned gearing mechanism, to draw oil through the drainback passageway. For example, in at least some of these embodiments, one or more fan blades or blade mechanisms 100 (as shown in FIGS. 10 and 10A), and/or one or more spoked ribs or ribbed mechanisms could be incorporated onto the camshaft 102 (e.g., a face of the camshaft) to generate a suction flow and draw oil through a drainback passageway 104.

Still referring to FIG. 6, once past the breather filter 32, gases (now substantially without oil) enter a breather exhaust gas chamber portion 72 of the breather chamber 30. Gases from the exhaust gas chamber portion 72 exit through a breather chamber exit passage 74, with the flow regulated via a reed valve assembly, generally referenced by numeral 76, comprising a reed valve 78, here used as a check valve. Notably, substantially only gaseous material (as opposed to blow-by which contains liquid or vapor oil), is permitted to pass through the reed valve 78 and the hose 79, with such flow indicated by arrows 80 and 82, respectively. The reed valve 78 opens when there is a pressure differential and closes when the pressure differential is eliminated.

Figure 7:
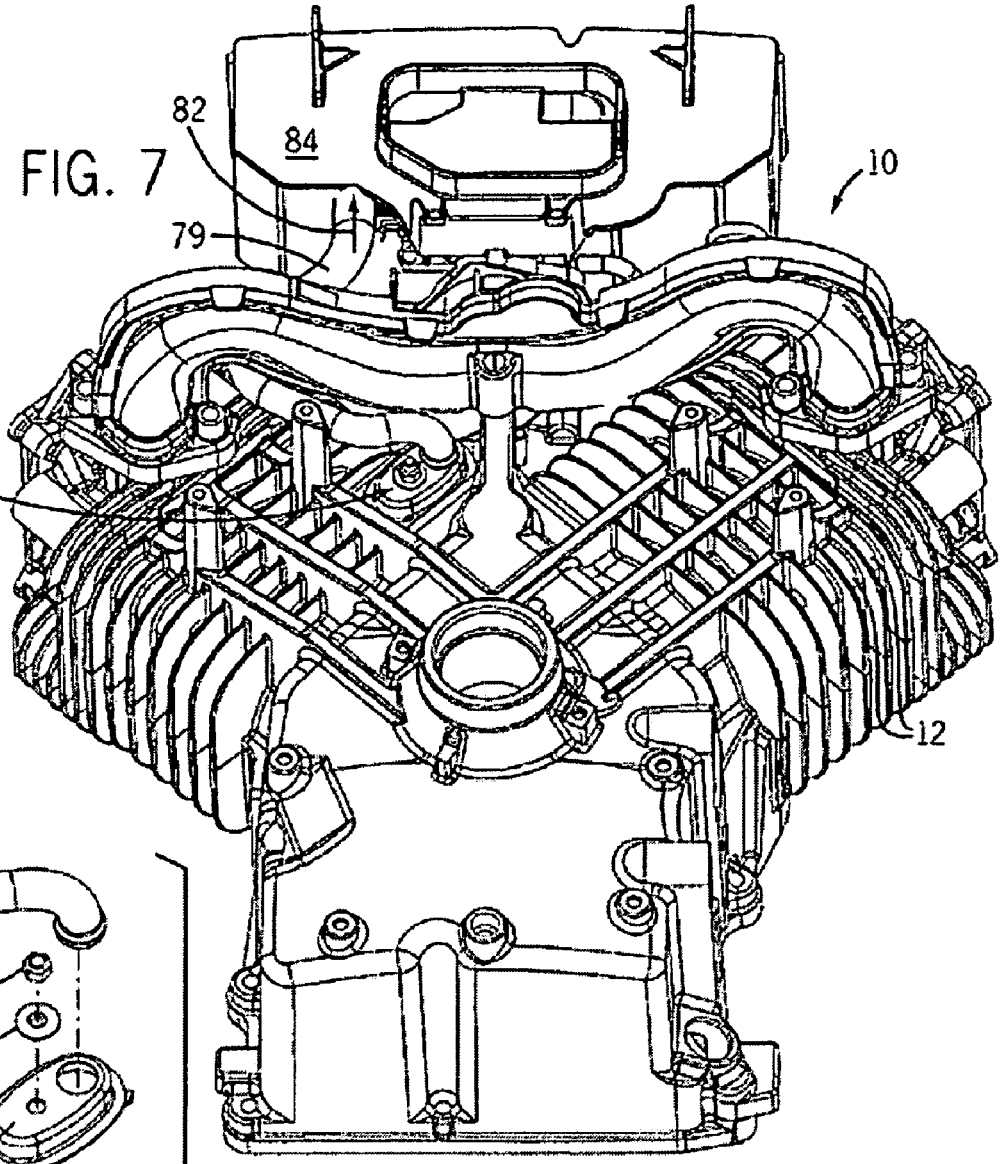
FIG. 7 is a partial frontal exterior perspective view of the engine of FIG. 1 including the internal breather and showing a reed valve assembly for use with the breather according to one aspect of some embodiments of the present invention.

FIG. 7 is a partial frontal exterior perspective view of the twin-V engine 10 including the breather (shown in the previous FIGS.) and showing the reed valve assembly 76 for use with the breather according to one embodiment of the present invention. Once gaseous material (without, or substantially without oil) passes the reed valve as described above, the gases pass through a hose 79 and into an air box or air intake 84, with the flow indicated by arrow 82. From the air cleaner 84, the gases are ultimately drawn into the carburetor as part of the intake charge. The air box 84 permits the gases to be fed back into the cylinders 12 of the engine 10, and this ultimately allows excess oil or fuel in the exhaust to be burnt off, thereby reducing particulate emissions into the environment.

Figure 8:
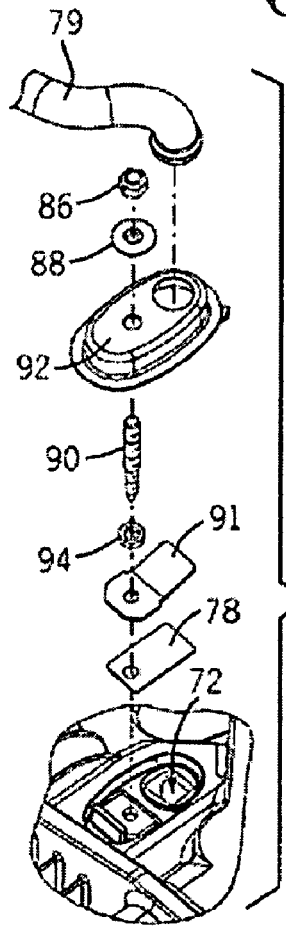
FIG. 8 is a partial exploded view of the reed valve assembly of FIG. 7.

FIG. 8 is a partial exploded view of the reed valve assembly 76 including the reed valve 78. As described with respect to FIG. 6, the valve 78 functions as a check valve by opening and closing, depending on whether or not there is a pressure differential, and thus the valve permits exhaust gases to exit the breather exhaust gas chamber portion, indicated by numeral 72 (and previously shown and referenced in FIG. 6). As described previously, when reed valve 78 is open, gases flow from the breather (see FIG. 6) into the air cleaner (see FIG. 7) via hose 79. Reed valve assembly 76 further includes a first nut 86 and washer 88 which engage threaded post 90 to secure reed valve cover 92 into place. The assembly also includes a second nut 94 that, in conjunction with a reed retainer 91, secures the reed valve 78 into position. While the valve assembly is illustrated as a reed valve assembly, it should be understood that it is contemplated that other relief valves can be used. Moreover, while the relief valve 78 is shown to be placed in communication with the breather exhaust gas chamber portion (FIG. 6), or in other words, near the breather exit, it should be understood that the relief valve can also be located elsewhere, for example, at or near an entrance of the breather. In short, the specific type and location of the pressure relief valve (or valve assembly) can be varied to convenience, and such variations are contemplated and considered within the scope of the present invention Turning to FIG. 9, a schematic representation is provided of the operation of the internal-type breather for incorporation into an internal combustion engine according to one embodiment of the present invention. A crankcase, referenced generally by number 200, is illustrated, and positioned within the crankcase is the breather, referenced generally by number 201. Also shown are a valve, referenced generally by numeral 202, and an oil recovery system, referenced generally by numeral 204, which have been described with respect to the figures above. The crankcase 200 includes a cover 206 and a main header assembly 208.

Figure 9:
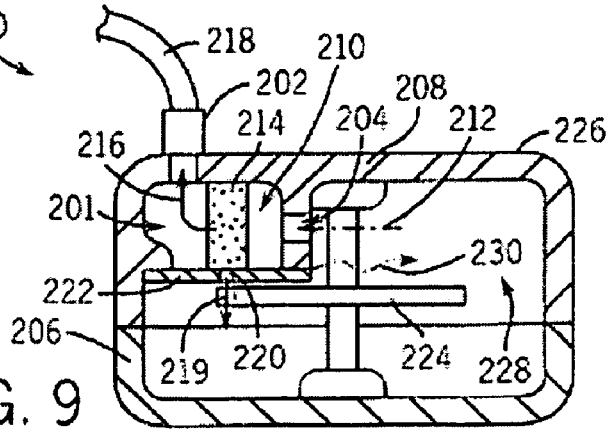
FIG. 9 is a schematic representation of the operation of the breather according to one aspect of the present invention.

Still referring to FIG. 9, the breather operates as follows. As the engine (not shown) runs, heated air is allowed to expand and flow into a breather box or chamber 210, as shown by arrow 212 (pointing to the left). Increased pressure within the chamber 210 pushes air/gases through breather media/filter element 214, but separates an amount of the oil (carried by the gases) from the blow-by so as to accumulate the oil in the filter. Gases are then allowed to escape or exit breather through the valve 202. The valve can be a one-way pressure relief (e.g., reed) valve. Exhaust gases exiting the breather are shown by curved arrow 216 (pointing up). The gases are then drawn into an air intake box (see FIG. 7) through a hose 218, shown positioned above the relief valve 202. These gases can then be drawn into the carburetor as part of the intake charge. Significantly, the oil that has been collected by the filter element 214 is drawn out of and away from the breather 201, as indicated by arrow 219 (pointing to the down) through a drainback passage 220, which is positioned in a breather cover/seal 222. More specifically, a gear mechanism 224 (e.g., helical gear) that is in mechanical association with a cam shaft 226 functions in fan-like fashion to draw the oil collected using the filter while the engine runs during normal operation. Advantageously, if the seal or gasket of the breather cover/seal 222 were to fail, the escaping gases will be contained within a crankcase compartment 228. Significantly, as a result, such gases (having pollutants) will not be permitted to exit to the outside environment. Containment of gases in the event of internal seal failure is indicated by arrow 230 (pointing to the right). In another embodiment, valve 202 can be placed at the entrance of chamber 210. Such placement would aid in drainback due to, at least in part, the breather chamber 201 operating at a higher pressure than crankcase compartment 228, and such vacuum would further draw flow out of hole 220.

It is specifically intended that the present invention not be limited to the embodiments and illustrations contained herein, but include modified forms of those embodiments including portions of the embodiments and combinations of elements of different embodiments as come within the scope of the following claims.

We claim:

1. An internal breather for removing oil from blow-by in an internal combustion engine, the breather comprising:

a breather cover having a breather cover drainback hole;

a breather cover seal in sealed engagement with the breather cover and having a breather cover seal drainback hole that is aligned with the breather cover drainback hole to create a drainback passage;

a breather chamber bounded on at least one end by the breather cover and the breather seal, and a breather media positioned within the breather chamber, the breather media for removing an amount of oil from the blow-by;

wherein the amount of oil removed from the blow-by can, during operation of the engine, be drawn through the drainback passage so as to exit the breather chamber, at least partially due to gravity, and at least partially using a gearing mechanism that is in operative association with a camshaft of the engine.

2. The internal breather of claim 1, wherein the gearing mechanism is a helical gearing mechanism and the drainback passage and gearing mechanism are positioned in-line with each other.

3. The internal breather of claim 1, wherein the breather chamber includes a first breather chamber portion, a second breather chamber portion in fluid communication with the first breather chamber portion, and an exit breather exhaust gas chamber portion in fluid communication with the second breather chamber portion and wherein the breather media is positioned within the breather chamber to remove the amount of oil from the blow-by in the second breather chamber portion and to permit exhaust gas to pass therethrough into the breather exhaust gas chamber portion.

4. The internal breather of claim 3 wherein the second breather chamber portion has a larger cross-sectional area than the first breather chamber portion such that there is a reduction in velocity of the blow-by passing from the first breather chamber portion to the second breather chamber portion prior to the blow-by passing into the breather media.

5. The internal breather of claim 3 further comprising a relief valve assembly in fluid communication with the second breather exhaust gas chamber portion, the assembly including a relief valve to permit exhaust gas to exit the breather exhaust gas chamber portion.

6. The internal breather of claim 5 wherein the relief valve is a reed valve.

7. The internal breather of claim 1 further comprising a one-way valve that permits exhaust gas to exit the breather chamber.

8. An engine comprising:

a crankcase defining a crankcase compartment; and a breather positioned within and in fluid communication with the crankcase compartment, the breather comprising:

a breather cover having a breather cover drainback hole;

a breather cover seal in sealing engagement with the breather cover and having a breather cover seal hole that is aligned with the breather cover drainback hole to create a drainback passage;

a breather chamber bounded on at least one end by the breather cover and the breather seal, and a breather media positioned within the breather chamber, the breather media for removing an amount of oil from the blow-by;

wherein the amount of oil removed from the blow-by can, during operation of the engine, be drawn through the drainback passage so as to exit the breather chamber, at least partially due to gravity, and at least partially using a gearing mechanism that is in operative association with a camshaft of the engine.

9. The engine of claim 8 further comprising a crankcase passageway formed within the crankcase, the crankcase passageway extending to, and in fluid communication with, the breather to permit blow-by to flow from the crankcase passageway into the breather.

10. The engine of claim 9 wherein the crankcase passageway is a cylinder head blow-by passageway that is defined by a cylinder head wall of a cylinder head.

11. The engine of claim 8 wherein the gearing mechanism is a helical gearing mechanism and the drainback passage and gearing mechanism are positioned in-line with each other.

12. The engine of claim 8 wherein the breather chamber includes a first breather chamber portion, a second breather chamber portion in fluid communication with the first breather chamber portion, and an exit breather exhaust gas chamber portion in fluid communication with the second breather chamber portion and wherein the breather media is positioned within the breather chamber to remove the amount of oil from the blow-by in the second breather chamber portion and to permit exhaust gas to pass therethrough into the breather exhaust gas chamber portion.

13. The engine of claim 12 wherein the second breather chamber portion has a larger cross-sectional area than the first breather chamber portion such that there is a reduction in velocity of the blow-by passing from the first breather chamber portion to the second breather chamber portion prior to the blow-by passing into the breather media.

14. The engine of claim 8 further comprising an air intake and wherein the breather further comprises a relief valve assembly in fluid communication with the second breather exhaust gas chamber portion, the assembly including a relief valve to permit exhaust gas to exit the breather exhaust gas chamber portion so as to be channeled into the air intake.

15. The engine of claim 8 wherein the relief valve is a reed valve.

16. The engine of claim 8 wherein the engine is a twin vee internal combustion engine.

17. The engine of claim 8 further comprising a one-way valve that permits exhaust gas to exit the breather chamber.

18. The engine of claim 8 further comprising a camshaft and wherein the camshaft includes at least one of one or more blade mechanisms and one or more ribbed mechanisms to generate a suction flow so as to draw oil through the drainback passageway.

19. A method for removing oil from blow-by in an internal combustion engine having an internal breather, the breather including a breather cover having a breather cover drainback hole, a breather cover seal in sealed engagement with the breather cover and having a breather cover seal drainback hole that is aligned with the breather cover drainback hole to define, a drainback passage, a breather chamber bounded on at least one end by the breather cover and the breather cover seal, and a breather media positioned within the breather chamber, the method comprising:

removing, during operation of the engine, an amount of oil from the blow-by by drawing the blow-by through the drainback passage so as to exit the breather chamber; and wherein the drawing is accomplished at least partially due to gravity and at least partially using a gearing mechanism that is positioned in-line with the drainback passage.

20. The method of claim 19 further comprising removing an amount of exhaust gas from the breather chamber using a one-way valve.

* * * * *